US005123681A

United States Patent [19]

Kos et al.

[11] Patent Number: 5,123,681

[45] Date of Patent: Jun. 23, 1992

[54] LATCH FOR WAFER STORAGE BOX FOR MANUAL OR ROBOT OPERATION

[75] Inventors: Robert D. Kos, Victoria; Tracy J. Niebeling, Minneapolis; Shawn D. Eggum, Chaska, all of Minn.

[73] Assignee: Fluoroware, Inc., Chaska, Minn.

[21] Appl. No.: 672,467

[22] Filed: Mar. 20, 1991

[51] Int. Cl.[5] ..... E05C 19/06

[52] U.S. Cl. ..... 292/87; 292/DIG. 38; 220/334

[58] Field of Search ..... 292/DIG. 38, 87, 89; 220/334, 324, 326, 325; 206/328, 454

[56] References Cited

U.S. PATENT DOCUMENTS

| | | | |
|---|---|---|---|
| 3,134,617 | 5/1964 | Slonneger | 292/83 |
| 3,822,905 | 7/1974 | Bell | 292/DIG. 38 |
| 3,961,877 | 6/1976 | Johnson . | |
| 3,971,237 | 7/1976 | Rasmussen | 292/87 |
| 4,270,668 | 6/1981 | Berfield | 220/324 |
| 4,344,646 | 8/1982 | Michel | 292/DIG. 38 |
| 4,501,378 | 2/1985 | Berfield | 292/DIG. 38 |
| 4,542,924 | 9/1985 | Brown et al. | 292/87 |
| 4,830,182 | 5/1989 | Nakazato et al. | 277/168 |
| 4,917,244 | 4/1990 | Sayers | 292/DIG. 38 |
| 4,925,041 | 5/1990 | Penr | 292/DIG. 38 |
| 4,964,661 | 10/1990 | Cadwell et al. | 292/DIG. 38 |

FOREIGN PATENT DOCUMENTS

| | | | |
|---|---|---|---|
| 969994 | 6/1975 | Canada | 292/DIG. 38 |
| 2443 | 6/1979 | European Pat. Off. | 292/DIG. 38 |
| 194551 | 1/1958 | Fed. Rep. of Germany | 292/87 |
| 1781476 | 9/1979 | Fed. Rep. of Germany | 292/DIG. 38 |

*Primary Examiner*—Eric K. Nicholson
*Attorney, Agent, or Firm*—Palmatier & Sjoquist

[57] ABSTRACT

A silicon wafer storage box must be secured by a functional and convenient latch during the fabrication and transportation of silicon wafers. The present invention encompasses such a functional, convenient latch adaptable for either manual or automated manipulation. The invention includes a rigid upper tab having a peg adapted for interaction with a robot arm of an automated process. The invention also includes a resiliently flexible bottom bight having a horizontally extending rigid lower tab, adapted for manual manipulation. The invention permits convenient, efficient manipulation of the latch by either a person or by an automated process.

8 Claims, 2 Drawing Sheets

LATCH FOR WAFER STORAGE BOX FOR MANUAL OR ROBOT OPERATION

BACKGROUND OF THE INVENTION

Silicon wafers are manufactured for use in integrated circuits. During the fabrication process the wafers are often transported and stored between various process steps. Protecting the wafers from damage or contamination during the manufacturing process and storage is of paramount importance. Silicon wafers are carried, transported and stored in wafer carriers as disclosed in the prior art, a typical example of which includes U.S. Pat. No. 3,961,877.

The wafer carrier that holds the fragile silicon wafers is stored and/or transported inside of a securable storage box. The securable storage box reduces both breakage and contamination of the silicon wafers.

The securable wafer storage box is preferably opened and closed by automated machinery during the manufacture or delivery process, and also must be accessible manually.

SUMMARY OF THE INVENTION

The present invention is a latch for a silicon wafer storage box.

The wafer storage box must be secured by a functional and convenient latch. The present invention encompasses such a functional, convenient latch adaptable for either manual or automated manipulation. Prior art latches have only been marginally usable with automatic machinery for opening and closing such wafer storage boxes.

An object of the invention is to provide a latch capable of manipulation and release by automated machinery or by a person manually.

Another object of the invention is the provision of a new and improved latch of relatively simple and inexpensive construction and operation, which is safe, durable, and performs consistently in conjunction with a silicon wafer storage box, without fear of damage to property, equipment, and/or injury to persons.

A feature of the invention is a rigid upper tab having a peg adapted for engagement with a robot arm mechanism of automated machinery.

Another feature of the invention is a curved resiliently flexible bight having a horizontally extending rigid lower tab, adapted for manual manipulation in releasing the latch invention while affixed to a wafer storage box in a closed position.

An advantage of the invention is the flexibility of the latch which permits convenient, efficient manipulation either by a person or by automated machinery.

DETAILED DESCRIPTION OF THE PREFERRED EMBODIMENT

Figure 1:
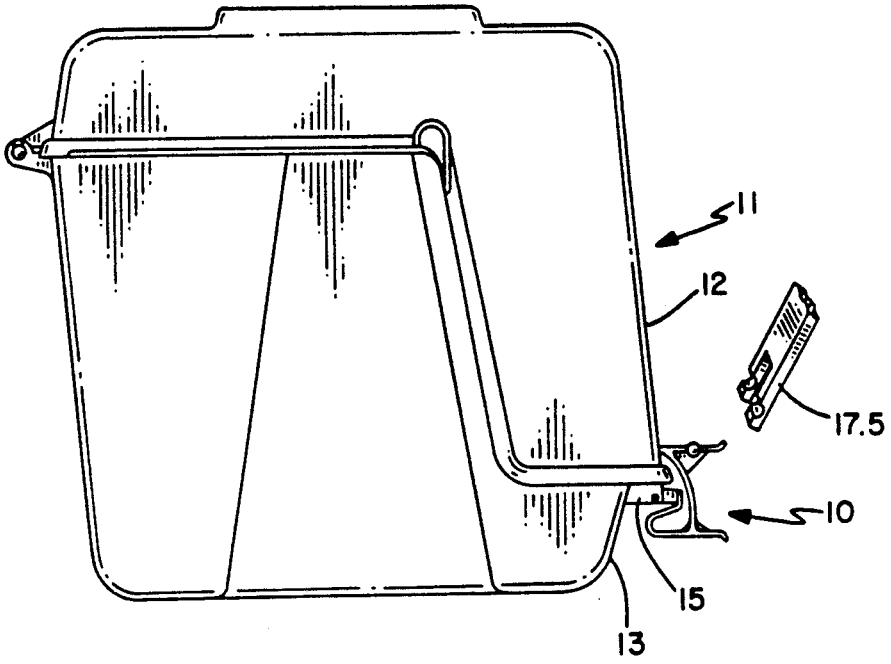
FIG. 1 is a side elevational environmental view of the wafer storage box showing the hinge, latch, and partial robot arm with hook.

One form of the invention is illustrated and described herein. The latch is indicated in general by the numeral 10. The latch 10 is preferably used with a silicon wafer storage box indicated in general by the numeral 11. Preferably, there are two latches 10 for each storage box 11. The storage box 11 contains a cover 12 and a base 13. A keeper 14 is molded into the cover 12 for interaction with each latch 10. Latch mountings 15 are molded or affixed to the base 13 at two locations for interaction with each latch 10 A total of four latch mountings 15 will be molded or affixed to the base 13 for a complete wafer storage box system. (See FIGS. 1, 2, 5).

The latch mountings 15 are substantially rectangular in shape providing rigid engagement between the latch 10 and the silicon wafer storage box 11.

The latch 10 is preferably of one-piece molded construction of a material that simultaneously provides resilient flexibility and rigidness. An example of such a material is carbon filled polycarbonate plastic.

Figure 2:
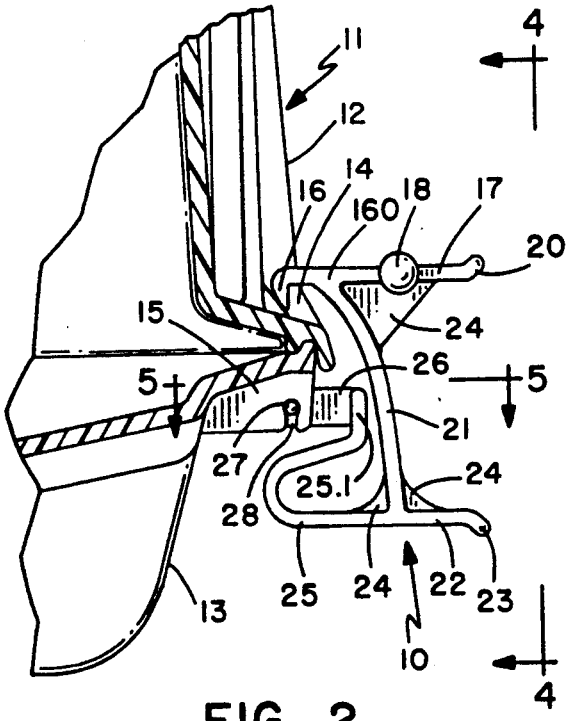
FIG. 2 is an enlarged detail section view through the box showing the latch in a closed position.

The latch 10 may be released from a closed position as shown in FIGS. 1 and 2 by mechanical manipulation through the use of a robot arm 17.5.

The latch 10 contains a catch portion 160 as a principal portion thereof. The catch portion 160 includes a catch 16 which interacts with the keeper 14, fastening the cover 12 to the base 13. The catch 16 is preferably hook shaped but may only need a detent in some cases. The interaction between the catch 16 and the keeper 14 locks the box 11 in a closed position. The latch 10, keeper 14, latch mountings 15, and catch 16 will vary in size depending upon the dimensional requirements of the corresponding silicon wafer storage box 11 known in the art.

The catch portion 160 includes an upper operating tab 17. The upper tab 17 is of rigid construction providing strength to the latch 10 when manipulated by either a person, or by a robot arm 17.5. The upper tab 17 contains an elongated connector peg 18. The elongated connector peg 18 is located adjacent to the catch 16. The connector peg 18 preferably traverses the entire width of the upper tab 17 extending beyond the edges 19 of the upper tab 17. (See FIG. 4) The connector peg 18 extends beyond the edges of the upper tab 17 providing two ends for convenient engagement by a robot arm 17.5. The connector peg 18 is preferably cylindrical. The length and diameter of the cylindrical connector peg 18 will be sufficient to interact efficiently with either a claw or bar type robot arm 17.5 of an automated assembly process. The connector peg 18 is of rigid construction, thereby preventing the bending or fracture of the peg 18 during manipulation by the robot arm 17.5 in the releasing/locking of the silicon storage box 11.

The upper operating tab 17 may contain an upturned end 20 opposite the catch 16. The upturned end 20 provides for convenient grasping of the tab 17 by an individual during manual manipulation of the latch 10.

The upper operating tab 17 is preferably molded to a depending resiliently flexible upright body 21. The upright body 21 will flex when a force is applied to either the connector peg 18 or the upper tab 17. The flexibility of the upright body 21 will assist in the releasing and locking of the catch 16 to the keeper 14 as desired for opening and closing of the storage box 11.

A lower operating tab 22 is preferably molded to the bottom of the upright body 21. The lower tab 22, like the upper tab 17, is of rigid construction. The lower tab 22 may contain a downturned end 23 providing increased convenience to an individual in grasping the tabs 17, 22 during manual manipulation of the latch 10. The upper and lower tabs 17, 22, including the turned ends 20, 23 respectively, remain in a confrontational relationship to each other.

Supports 24 are molded between the upright body 21 and the upper tab 17, lower tab 22, and curved bight 25. The supports 24 are molded to the upright body 21, upper tab 17, lower tab 22, and curved bight 25 substantially equidistant between the edges 19 of the upright body 21. The molded supports 24 facilitate in maintaining rigidity of the upper and lower tabs 17, 22, while simultaneously not inhibiting the flexibility of the upright body 21.

The curved bight 25 is preferably an an edgewise U-shape, and is molded along the lower open end to the lower tab 22. The opposite end 25.1 of the curved bight 25 is molded to a pair of pivot portions 26. The curved bight 25 is resiliently flexible. During the releasing and locking of the latch 10 relative to the cover 12, the curved bight 25 and the upright body 21 will flex. During a releasing manipulation of the latch 10 the curve of the bight 25 will constrict, thereby providing slack for the catch 16 to be pulled and moved upward and away from the keeper 14, whereby release of the latch 10 from a locked position will occur. The curved bight 25 will also constrict while the upper tab 17 and catch 16 are manipulated together in order to affix the latch 10 into a locked configuration.

Figure 5:
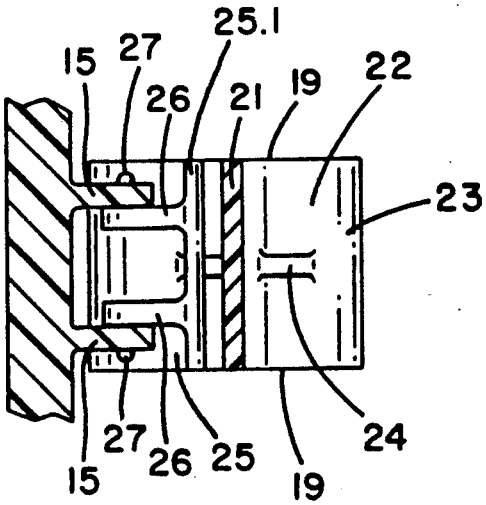
FIG. 5 is a detail section at 5—5 of FIG. 2.

Molded to the opposite end 25.1 of the curved bight 25, at two locations, are pivot portions 26. Each pivot portion 26 is generally rectangular in shape and contains a pivot pin 27. The pivot pins 27 are located centrally on the exterior surfaces of the pivot portions 26 proximal to the latch mountings 15 of the base 13. As seen in FIG. 5 the pivot portions 26 are offset equidistant inside the sides 19 of the latch 10. The pair of pivot portions 26 are preferably centrally spaced and molded to the curved bight 25, such that, the pair of pivot portions 26 may be inserted for flush contact between the exterior surface of the pivot portions 26 and the interior surfaces of the latch mountings 15. The pivot portions 26 are of a sufficient length to maintain an open space between the pivot portions 26 and the base 13 while the latch 10 is in a locked position as seen in FIG. 2. The pivot portions 26 provide rigid strength sufficient to prevent flexing or bending of the upper end of the curved bight 25 during the releasing/locking manipulation of the latch 10. The pivot portions 26 provide for swingable engagement between the latch 10 and the base 13 of the silicon wafer storage box 11. The pivot portions 26 in conjunction with the pivot pins 27 provide the mechanism for positioning of the latch 10 in either the opened or locked configuration.

Figure 3:
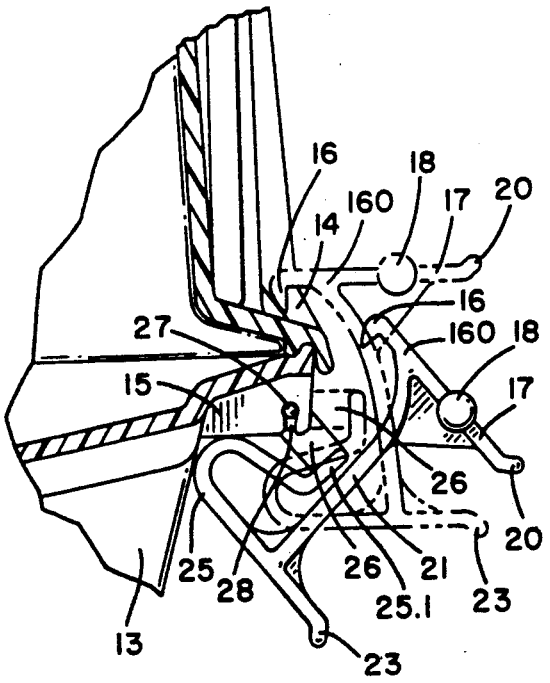
FIG. 3 is an enlarged detail section view through the box showing the latch detached from the keeper tilted downward with the bight of the latch lying against the front face of the base of the wafer storage box.
Figure 4:
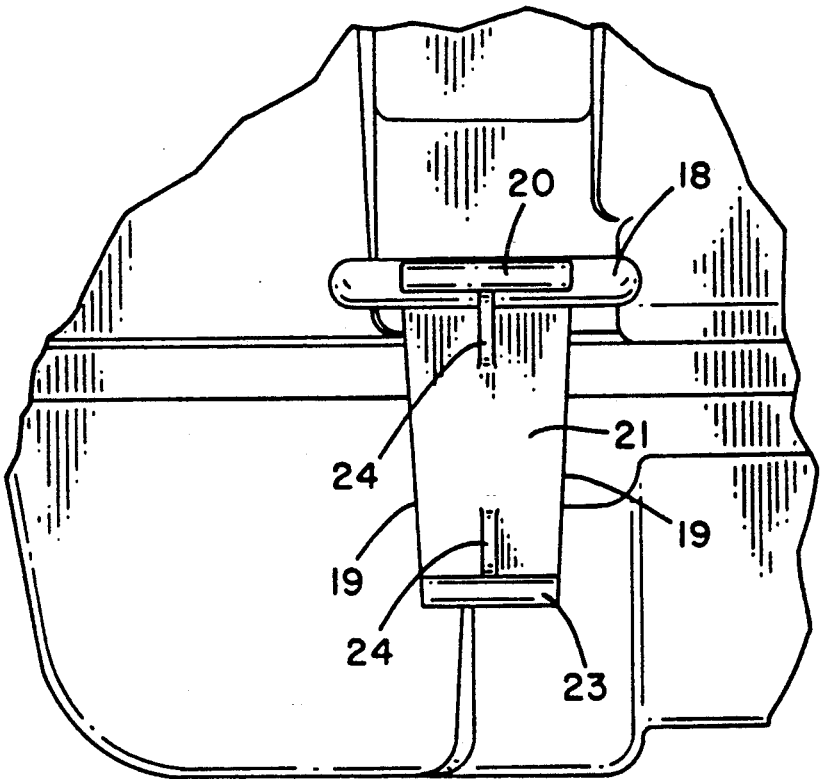
FIG. 4 is a detail elevation view at 4—4 of FIG. 2.

In order to mechanically manipulate the latch 10, while locked in a closed position as seen in FIG. 2, a robot arm 17.5 will engage the two protruding ends of the connector peg 18 from below. The robot arm 17.5 will lift the connector peg up and back away from the cover 12. This movement will simultaneously cause flexing of the curved bight 25 and a slight oscillation of pivot portions 26. The hook of the catch 16 will then release upward and away from the keeper 14, whereon elevation of the connector peg 18 may be terminated and release the connector peg 18 by the robot arm 17.5 may occur. The latch 10 may then return to a relaxed configuration as seen in FIG. 3. In the relaxed configuration the upright body 21 is slightly bowed in a convex configuration, with the catch 16 in a closer proximity to the curved bight 25 than while the latch 10 is affixed in a locked position as seen in FIG. 2. The slightly bowed configuration of the body 21 assists in maintaining the latch 10 in a locked position as seen in FIGS. 1, 2 and 4.

In order to manually manipulate the latch 10, while locked in a closed position as seen in FIG. 2, a person will grasp the upper and lower tabs 17, 22 near the ends 20, 23 and apply constricting force to move the tabs 17, 22 and the ends 20, 23 toward each other. The flexible upright body 21 will then bend while the tabs 17, 22 remain resilient. The hook of the catch 16 will then release upward and away from the keeper 14 whereon constricting pressure to the tabs 17, 22 may be terminated. The latch 10 will then return to a relaxed configuration as seen in FIG. 3. Alternately, in some instances the latch may be manually operated by manually lifting the ends of peg 18, either to close the latch or to open the latch. In all events care must be taken to avoid tipping the container 11 during opening or closing of the latch.

In the relaxed configuration the upright body 21 is slightly bowed in a convex configuration, with the catch 16 in a closer proximity to the curved bight 25 than while the latch 10 is affixed in a locked position as seen in FIG. 2. The slightly bowed configuration of the body 21 assists in maintaining the latch 10 in a locked position as seen in FIGS. 1, 2, and 4.

Upon release of the latch 10 from a locked position as see in FIGS. 2, 3 the latch will initially swing up and away from the storage box cover 12 and will then descend downward and backward, via the pivot pins 27 and pivot portions 26, until the exterior surface of the curved bight 25 rests against the base 13 and the latch mountings 15. (FIGS. 2, 3). The exterior surface of the curved bight 25 and/or the exterior surfaces of the base 13 or latch mountings 15 may contain a bumper in order to facilitate the positioning of the latch 10 while the latch 10 remains in an unlocked or rest position.

The latch 10 is preferably constructed such that the weight of the catch 16, upper tab 17, connector peg 18, and upright body 21, with the assistance of gravity, will shift the curved bight 25, via the pivot portions 26 and pivot pins 27, to a relaxed position. In this relaxed position the curved bight 25 remains in flush contact with the base 13 and the mounting tabs 15. (FIG. 3)

The position of the latch 10 while located in the locked position (FIG. 2) or in the rest position (FIG. 3) will provide two preset locations for the connector peg 18. The two preset locations for the connector peg 18, are easily recognizable by, or programmable into, a robot arm as part of an automated machinery process. The two preset positions of the connector peg 18 facilitate the automated manipulation of the opening/locking of the latch 10 in the automated process. When the latch is locked, the connector peg 18 is located in a position substantially horizontal to and forward of the cover 12. When the latch 10 is released, the connector peg 18 is located in an alternative position which is lower, substantially forward of, and horizontal to the latch mounting 15 of the base 13.

A pivot pin 27 fits precisely into and interacts with the pivot openings 28 located in the latch mountings 15. (FIG. 2) The junction between the pivot pins 27 and the openings 28 permit swingable engagement between the latch 10 and the silicon wafer storage box 11. The pivot openings 28 may either be circular or shaped in the form of a keyhole for joinder of the pivot pins 27 to the openings 28.

A modified form of latch may be useful in some instances. For instance the peg 18 may be located on the upper portion of the upright body 21, which may be considered a portion of the catch portion 160.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A manually and robot operated latch for a two part silicon wafer storage box having a latch mounting portion on one part and a keeper portion on the other part for use with the latch, comprising:

a horizontally extending rigid upper tab portion, comprising a first end portion having a catch portion adapted for releasable attachment to the keeper portion, said horizontally extending rigid upper tab portion further comprising a second end portion having an elongate connector peg, a resiliently flexible curved bight portion having a horizontally extending rigid lower tab portion, said curved bight portion comprising an upper end portion having pivot portions, said pivot portions comprising pivot pins adapted for swingable connection to the latch mounting portion on the box, and an elongate upright resiliently flexible body portion formed integrally with and extending between the horizontally extending upper tab portion to the curved bight portion.

2. The latch according to claim 1, wherein the upper and lower tab portions confront each other.

3. The latch according to claim 1, wherein the connector peg is disposed adjacent the catch portion of the upper tab portion.

4. The latch according to claim 1, wherein the connector peg traverses said upper tab portion.

5. A manually and robot operated latch for a two part silicon wafer storage box having a latch mounting portion on one part and a keeper portion on the other part for use with the latch, comprising:

a horizontally extending rigid upper tab portion, comprising a first end portion having a catch portion, the catch portion comprising a hook shaped portion adapted for releasable engagement with the keeper portion, said horizontally extending rigid upper tab portion further comprising a second end portion having an elongate connector peg having opposite ends, disposed adjacent the catch portion, traversing the upper tab portion, said connector peg adapted to be alternately manually operated and robot operated for engaging or releasing the catch from the keeper portion, a resiliently flexible curved bight portion having a horizontally extending rigid lower tab portion, said lower tab portion adapted for confrontational relation to the upper tab portion, said curved bight portion comprising an upper end portion having pivot portions, said pivot portions comprising pivot pins adapted for swingable engagement to the latch mounting portion on the box, and an elongate resiliently flexible upright body portion formed integrally with and extending between the horizontally extending upper tab portion and the curved bight portion.

6. A manually and robot operated latch for a two part semiconductor wafer storage box comprising a latch mounting portion on the wall of the box bottom and a keeper portion on the box cover, the latch comprising a pivot portion swingably mounted on said latch mounting portion and a catch portion engaging the keeper portion, characterized in that an elongate and upright body portion connects to and depends from the catch portion and is formed integrally therewith, a robotic connector peg formed integrally of the catch portion and to be operated for releasing the catch portion, a resiliently flexible bight portion formed integrally with said body portion and said pivot portion, said bight portion extending transversely of said elongate body portion and extending upwardly to said pivot portion, and the bight portion being swingable toward and into engagement with the wall of the box bottom when the catch portion is released from the keeper portion, whereby the robotic connector peg resides in either of only two readily accessible locations when the catch portion is engaged with and disengaged from the keeper portion.

7. A manually and robot operated latch according to claim 6 and further characterized in that said elongate body portion is also resiliently flexible.

8. A manually and robot operated latch according to claim 7 and further characterized in that rigid tab portions protrude from opposite ends of the elongate body portion, said tab portions accommodating manual gripping in order to flex the body portion and thereby disengage the catch portion from the keeper portion.

* * * * *